United States Patent [19]

Kupiek et al.

[11] 3,956,970

[45] May 18, 1976

[54] MULTIPLE STAGE HYDRAULIC TELESCOPIC CYLINDER DEVICE

[75] Inventors: Heinrich Kūpiek, Holzwickede; Gerd Brackemann, Unna, both of Germany

[73] Assignee: Montanhydraulik GmbH & Co. KG, Holzwickede, Germany

[22] Filed: Nov. 23, 1973

[21] Appl. No.: 408,819

[30] Foreign Application Priority Data

Nov. 2, 1971 Germany ..... 2253645

[52] U.S. Cl. ..... 91/173; 91/168; 91/189 A

[51] Int. Cl.[2] ..... F15B 11/18; F01B 7/20

[58] Field of Search ..... 91/168, 189, 173

[56] References Cited

UNITED STATES PATENTS

| | | | |
|---|---|---|---|
| 762,627 | 6/1904 | Fink | 91/168 |
| 2,148,616 | 2/1939 | Gruber | 91/168 |
| 2,257,324 | 9/1941 | Behm et al. | 91/168 |
| 2,667,035 | 1/1954 | Marsden | 91/189 |
| 3,024,771 | 3/1962 | Criffield et al. | 91/189 |

FOREIGN PATENTS OR APPLICATIONS

| | | | |
|---|---|---|---|
| 413,185 | 3/1946 | Italy | 91/168 |
| 1,933,457 | 7/1970 | Germany | 91/168 |

*Primary Examiner*—Paul E. Maslousky

[57] ABSTRACT

A multiple stage hydraulic telescopic cylinder device includes two hollow pistons one movable within the other with a cylinder in which the outer piston moves. In the bottom part of the outer piston are two passages leading to the interior of the inner piston, one below and ther other above the piston area of the inner piston. Fluid under pressure is supplied to the interior of the cylinder below the outer piston, to lift it. This fluid is confined to the interior of the cylinder below the outer piston until the outer piston reaches its outmost position, whereupon a by-pass passage in the wall of the cylinder connects the interior of the cylinder to the passage in the bottom part of the outer cylinder which leads into the space of the inner cylinder below the piston portion thereof. The inner piston is then pushed out to its outer-most position.

For returning the parts, a reverse arrangement is provided including a passage in the bottom of the outer piston leading to the interior of the inner piston above the piston portion thereof.

11 Claims, 3 Drawing Figures

MULTIPLE STAGE HYDRAULIC TELESCOPIC CYLINDER DEVICE

BACKGROUND OF THE INVENTION

1. Field of the Invention

The invention relates to a multiple stage hydraulic telescopic cylinder with at least two hollow pistons displaceable one within the other and annular spaces between the individual telescoping sliding members; with a pressure medium conduit connected to the pressure space of the cylinder; and a pressure medium conduit connected to the annular space of the cylinder; a connection between the pressure space of the cylinder and the pressure space of the intermediate piston, and a connecting passage between the inner space of the piston and a connecting passage on the circumference of the cylinder; in the bottom of the intermediate piston as well as connections between the annular space of the cylinder and the inner space of the intermediate piston on the one hand and the annular space of the intermediate piston and the inner space of the lifting piston on the other hand.

2. The Prior Art

For mechanical reasons it is often desirable that in the construction of such multistage telescoping cylinders the first stage should be completely moved out before the outward movement of the following stage begins. In the construction of such a telescoping cylinder it is further more desirable that in the reverse travel the entrance of the following stage should first begin when the preceding stage has moved in. For telescopic arrangements, which operate with such telescoping cylinders, the same is true.

To provide a separate cylinder for each outward stage is from an apparatus point of view expensive. Besides the pipe connections necessary for the expansion stages beyond the first stage are subject to damage. There has been proposed the use of multistage telescoping cylinders, in which attempts have been made to achieve the desired type of and manner of outward and inward movement among other things through a surface dependent control for the operation of the telescoping parts. However the disadvantage is present with the surface dependent control that the control during progressive outward movement of the telescoping cylinders and the arm is rendered inaccurate through the frictional force which exists in all cases between the telescopic slides. It is naturally possible also to provide a valve controlled regulation for such telescoping cylinders, but such a solution is on the contrary from the point of view of construction very expensive and because of the number of control elements very subject to disturbance.

SUMMARY OF THE INVENTION

The invention satisfies the need for a telescoping cylinder which produces the desired outward and inward travel cycles with safety, has a small structural cost and is quite free of disturbance.

The purpose according to the invention is achieved with a telescoping cylinder of the previously described type which is characterised in that the end on the side of the cylinder of the connecting passage between the cylinder pressure space and the intermediate piston pressure space lies on the circumference of the bottom part of the intermediate piston and at a distance above the corresponding end of the connecting passage between the inner space of the lifting piston and the pressure connection on the circumference of the cylinder which is connected thereto; and that in the cylinder wall at a distance from the connection of the pressure medium pipe a by-pass feeding the interior of the cylinder is provided, which, in the outwardly moved position of the intermediate piston, leads around the bottom of the intermediate piston and lies opposite the end on the side of the cylinder of the connecting passage to the intermediate piston pressure space and constitutes the connection to the cylinder space, whereas the connection of the pressure medium passage with the corresponding end of the connecting passage to the lifting cylinder inner space lies opposite and constitutes the connection to the pressure medium passage on the periphery of the enclosed cylinder.

By this construction the connection to the intermediate piston pressure space during outward movement of the telescopic cylinders is first exposed through the arrangement of the end on the side of the cylinder pressure space of the connecting passage to the intermediate piston pressure space to the bypass in the walls of the cylinder with the outwardly moving intermediate piston. The arrangement for the outward movement of the next stage is then provided by the complete outward movement of the preceding stage. Likewise the inward movement of the intermediate piston is only possible if the lifting piston is completely withdrawn.

According to the invention, the telescopic cylinder using the principle of slide control brings without the heretofore necessary control elements, in the nature of valves, throttles and the like, the desired outward and inward movement cycle. The relatively wear-free and disturbance-free slide control accomplishes the necessary efficiency of operation of the telescoping cylinders with great freedom from disturbance. A mis-setting of the working cycle through outward influences is avoided. A further advantage of the telescoping cylinders according to the invention is the light and compact construction.

Although the use of the basic principle of the invention is in general restricted in the disclosure to two-stage telescoping cylinders, in other cases the use of more than two stages in a corresponding system is not excluded. Within the scope of the invention also, if the construction is so suited, the working operating rythm is controlled only in a one working direction.

For a smooth and continuous supply of the working fluid uninfluenced by turning of the telescoping slides, it is advantageous if the connecting passages in the bottom part of the intermediate piston end in annular grooves in the circumference of the intermediate piston bottom while the connection for the pressure medium connection in the cylinder wall ends in an annular groove and the bypass provided in the cylinder wall for by-passing between the cylinder pressure space and the intermediate piston pressure space is constructed as an annular groove. It is especially advantageous for the comparatively broad by passing operation for the annular groove while leaving flow-through passages at the upper and lower edge to be covered by a surface part which is flush with the inner surface of the cylinder because with broader annular grooves there exists the danger of damage to the sliding seals.

For the by-passing also several partly covered channels can be provided around the circumference of the cylinder wall extending in the vertical direction.

BRIEF DESCRIPTION OF THE DRAWINGS

In the drawings, which show a two stage lifting device.

DESCRIPTION OF THE PREFERRED EMBODIMENTS

Figure 1:
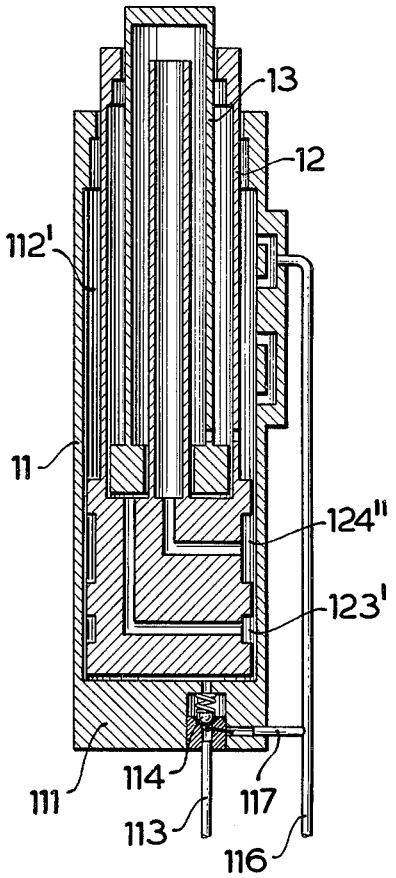
FIG. 1 shows the lifting device in the contracted condition.
Figure 3:
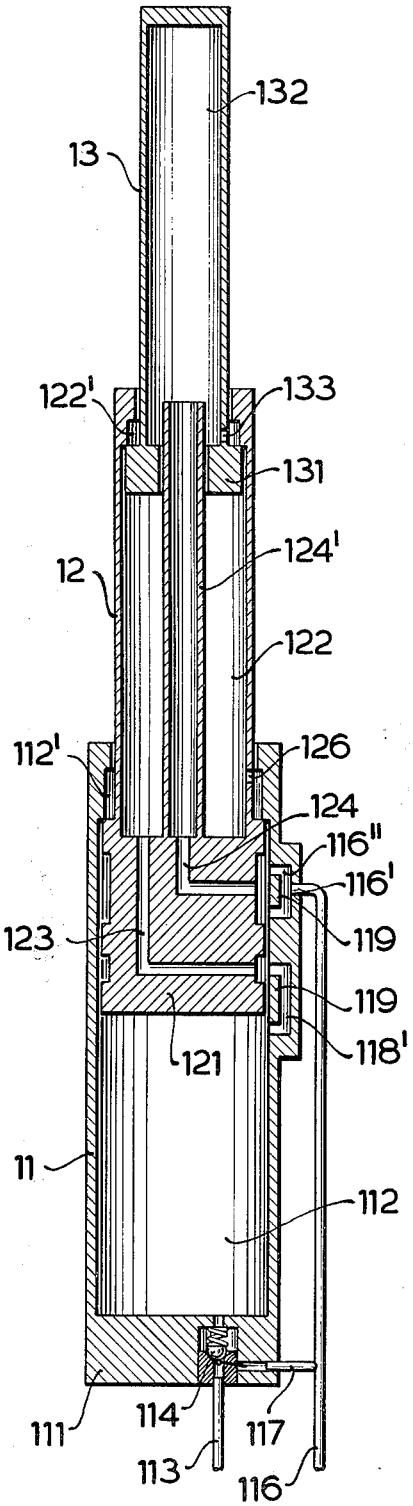
FIG. 3 shows the completely extended lifting device.
Figure 2:
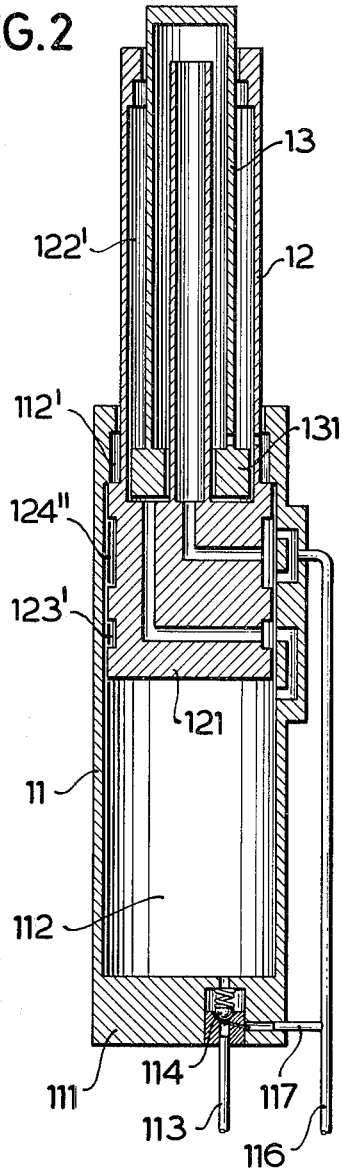
FIG. 2 shows the lifting device in the first outward stage.

The lifting device consists of a cylinder 11, a hollow intermediate piston 12 movably mounted in the annular space 112' left in the piston 11 and the hollow lifting piston 13 which is displaceably mounted in the hollow intermediate piston 12 through provision of an annular space 122'. A pressure medium connection 113 is connected at the bottom 111 of the cylinder 11 to the pressure space 112. A check valve 114 controlled by a diagrammatically illustrated control mechanism including passage 117 is arranged therein in passage 113. A pressure medium connection 123 is connected to the pressure space 122 and the intermediate piston 12 at the bottom 121 of the intermediate piston 12. A pressure medium passage 124 projects through the pressure space 122 up into the hollow lifting piston 13. A pressure medium conduit 116 connected above the head to the annular space 112' between the cylinder 11 and the intermediate piston 12 from which a control passage 117 leads to the check valve 114.

The end of the pressure medium passage 123 remote from the pressure space 122 of the intermediate piston 12 in the bottom part 121 of the intermediate piston 12 opens into an annular groove 123' on the circumference of the bottom part 121; likewise the pressure medium conduit 124 in the bottom 121 of the intermediate piston 12 opens on the side remote from the lifting piston 13 in an annular groove 124'' on the circumference on the bottom part 121 at a distance above the annular groove 123'. On the upper part of the cylinder 11 two passages 118' and 116'' are provided at a distance from each other, of which the lower 118' during the outward movement of the intermediate piston 12 lies opposite the annular groove 123' in the bottom part 121 of the intermediate piston 12 and the cylinder pressure space 112 and the upper one (116'') lies opposite to the pressure medium connection 116 connected with the annular groove 124''.

The passages 118' and 116'' in the cylinder wall are covered while leaving through flow openings at the upper and lower edges through surface parts 119 flush with the inner surface of the cylinder wall.

The annular space 112' between the cylinder 11 and the intermediate piston 12 is short-circuited by an opening 126 in the area of the intermediate piston bottom part with the inner space 122,122' of the intermediate piston 12; the annular space 122' between the intermediate piston 12 and the lifting piston 13 is short-circuited by a passage 133 in the area of the lifting piston bottom part 131 with the inner space 132 of the lifting piston 13.

The operation of the lifting device is as follows:

When the lifting device expands through the introduction of pressure medium through the pressure medium passage 113 into the pressure space 112, only the bottom 121 of the intermediate piston 12 is supplied with pressure and only the intermediate piston 12 is moved out. When the intermediate piston 12 has moved to its end position of outward movement, the pressure medium flows through the pressure medium passage 113 to the pressure space 112, through the by-pass gap 118' in the wall of the cylinder 11 to the pressure medium conduit 123 in the bottom part 121 of the intermediate piston 12, which opens into the pressure space 122 of the intermediate piston 12 and exerts pressure on the bottom 131 of the lifting piston 13, which now moves out.

During the outward movement of the intermediate piston 12 the pressure medium flows from the annular space 112' between the cylinder 11 and the intermediate piston 12 through the pressure medium conduit 116 and pressure medium flows from the annular space 122' between the intermediate piston 12 and the lifting piston 13 through the passage 133 through the pressure medium conduit 124'', 124 producing outward movement of the lifting piston 13.

For inward movement of the device, the pressure medium is supplied through the pressure medium conduit 116 to the system. At this time by the control connection 117 the check valve 114 in the pressure medium conduit 113 is lifted, so that pressure medium on the side of the pistons can flow out. Then the lifting piston 13, under the effect of the pressure medium flowing through the corresponding passages 116'', 124'' through the connecting passages 124,124' into the interior 132 of the lifting piston 13 and through passage 133 into space 122', moves down until its bottom 31 rests against the bottom part 121 of the intermediate piston 12, whereupon the intermediate piston 12 after the opening 126 into the annular space 112' of the bottom part 131 is reached, through the pressure supplied to the annular chamber 112' by pressure medium flowing through the lifting piston 13 moves downwardly, until the pressure medium conducted through the pressure medium passage 116 acts directly on top of the bottom part 121 of the intermediate piston 12 and the intermediate piston 12 is completely retracted.

While for convenience the device is described with reference to the upright position shown in the drawings, as for example by reference to the bottom part of the intermediate piston and to the passage 124 opening above the passage 123 in the wall of the bottom of the intermediate piston 12, the device could obviously be positioned and used in any desired orientation.

The total cross-sectional area of the top surface of the piston part of the lifting piston 13, including the part which forms the bottom of the annular space 122', is greater than the cross-section of the interior of the hollow piston.

During downward movement of the first piston 12, the bypass 116' connects the conduit 116 to the annular space 112' before it is disconnected from the passage 124.

We claim:

1. A multistage fluid-pressure telescoping hydraulic cylinder arrangement comprising a cylinder member (11), a first hollow piston member (12) slidable in said cylinder member and having a bottom part and having a portion above the bottom part and a second hollow piston member (13) slidable in the first piston member and having an upper part and a bottom part, with a first annular space 112' between the portion of the first piston member above the bottom part and the interior of the cylinder and a second annular space (122') between the part of the second piston member above the bottom part thereof and the interior of the first piston member, first means (113) to supply pressure fluid to the interior of the cylinder member below the first piston member, a first connection (123) in the bottom part of the first piston member connected at a first end to the interior of the first hollow piston member below the second piston member and having its second end opening in the peripheral wall of the bottom part of the first piston member, and a first bypass means in the interior wall of the cylinder opposite the position of the second end of the first connection when the first piston member is in its fully raised position for connecting the interior of the cylinder through said first connection with the interior of the first hollow piston member below the second hollow piston member, whereby upon such supply of fluid the first hollow piston member moves to its fully raised position, whereafter the second hollow piston member is raised, a second connection (124) in the bottom part of the first piston having a first end opening into the second hollow piston member above the bottom thereof and having its second end opening in the peripheral wall of the bottom part of the first piston member at a point above the second end of the first connection, second fluid pressure supply means (116) opening through the cylinder wall at a point opposite the position of the second end of said second connection, when the first piston member is in its fully raised position and a second bypass means into which said second fluid pressure supply means opens in the interior wall of the cylinder opposite the position of the second end of the second connection when the first piston member is in its fully raised position, there being a space between the second end of the second connection and the interior of the cylinder, said second bypass member bridging said last space during the retracting movement of the first piston member, whereby pressure fluid supplied to the interior of the second piston member through said second fluid pressure supply means causes said second piston means to retract and thereafter causes the first piston member to retract.

2. In an arrangement as claimed in claim 1, said first piston member having a third connection (126) into the first annular space adjacent the bottom of the hollow portion thereof, said third connection being uncovered when the second piston member reaches its retracted position whereby pressure fluid from said second supply means enters said first annular space above the bottom part of the first piston member.

3. In an arrangement as claimed in claim 3, a fourth connection (133) in the wall of the second piston member adjacent the bottom of the hollow portion thereof connecting the interior of the second piston member to the second annular space (122').

4. In an arrangement as claimed in claim 1, a third connection (133) in the wall of the second piston member adjacent the bottom of the hollow portion thereof connecting the interior of the second piston member to the second annular space (122').

5. In an arrangement as claimed in claim 1, said bottom part of the first piston member having a first annular groove (124'') in the periphery thereof, said second end of the second connection opening into said annular groove.

6. In an arrangement as claimed in claim 5, said bottom part of the first piston member having a second annular groove (123') therein, the second end of the first connection opening into said second annular groove, said second annular grove being located below said first annular groove.

7. In an arrangement as claimed in claim 1, the bottom part of the first piston member having a first annular groove (123') in the periphery thereof, the second end of the first connection opening into said first annular groove.

8. In an arrangement as claimed in claim 1, said bypass means comprising an annular groove in the inside of the cylinder wall.

9. In an arrangement as claimed in claim 8, means having a surface flush with the interior of the cylinder wall covering the central portion of said groove.

10. In an arrangement as claimed in claim 1, a check valve (114) in said first fluid supply means for normally preventing flow of pressure fluid out of the arrangement.

11. In an arrangement as claimed in claim 10, means responsive to operation of said second fluid supply means to render said check valve inoperative, whereby to permit the escape of the pressure fluid through said first fluid supply means.

* * * * *